United States Patent [19]

Kitzerow

[11] 4,227,823

[45] Oct. 14, 1980

[54] WRITING INSTRUMENT

[75] Inventor: Ernst R. Kitzerow, Wedel, Fed. Rep. of Germany

[73] Assignee: Berendsohn AG, Hamburg, Fed. Rep. of Germany

[21] Appl. No.: 972,764

[22] Filed: Dec. 26, 1978

[30] Foreign Application Priority Data

Jan. 26, 1978 [DE] Fed. Rep. of Germany ... 7802226[U]

[51] Int. Cl.[3] ..... B43K 7/12

[52] U.S. Cl. ..... 401/99

[58] Field of Search ..... 401/99, 6, 29, 30, 31, 401/32

[56] References Cited

U.S. PATENT DOCUMENTS

| | | | |
|---|---|---|---|
| 2,219,000 | 10/1940 | Williams | 401/29 |
| 3,158,138 | 11/1964 | Bross | 401/29 |
| 3,407,021 | 10/1968 | Mosch | 401/29 |
| 3,994,605 | 11/1976 | McKnight | 401/99 |

*Primary Examiner*—John D. Yasko

*Attorney, Agent, or Firm*—A. C. Nolte, Jr.; Edward B. Hunter; Jay P. Maioli

[57] ABSTRACT

A retractable ballpoint pen has a body and a point secured to a flexible tubular ink reservoir. The ink reservoir is secured to a rotatable element within the body, movement of which element causes the pen to be retracted and projected and during that movement the reservoir follows a generally circular path.

18 Claims, 5 Drawing Figures

Fig. 3
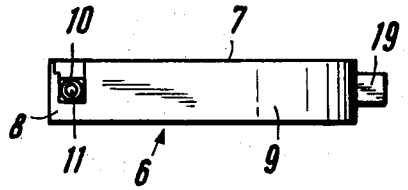
Fig. 2
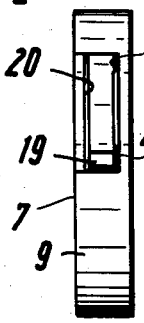
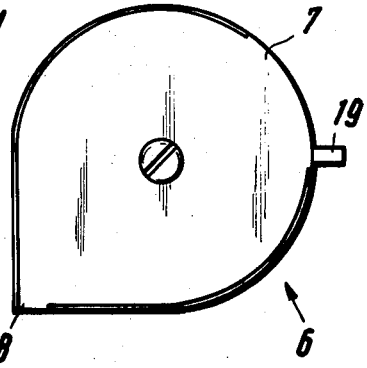
Fig. 1
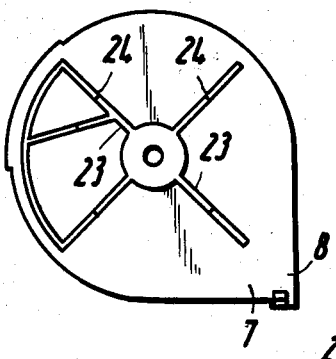
Fig. 5
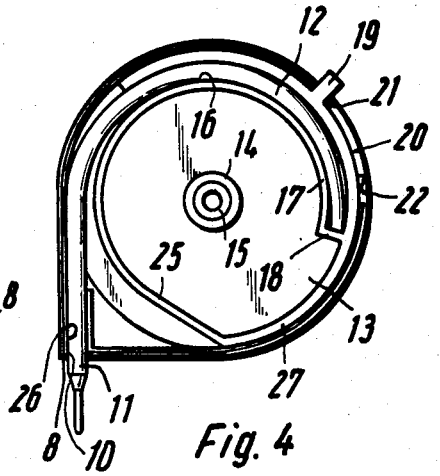
Fig. 4

WRITING INSTRUMENT

BACKGROUND OF THE INVENTION

This invention is concerned with a so-called retractable writing instrument that is to say an instrument having a housing with a writing point which is shiftable relative to the housing together with a connected ink reservoir between a projected, writing position, and a retracted inoperative position. The invention is particularly, but not necessarily exclusively concerned with a ballpoint pen. Conventional ballpoint pens are of generally rod-shape and are usually provided with a clip on the body part by which the pen may be held securely in a pocket. Because known pens are long, they are relatively cumbersome and cannot, without inconvenience, be carried in a pocket since, of course, the material forming the pocket tends to follow the movements of the wearer of the garment and of course this movement is restricted by the pen.

In is an object of the present invention to provide a writing instrument of the so-called retractable type which is very much more convenient to carry than the known rod-like pen.

SUMMARY OF THE INVENTION

According to this invention there is provided a writing instrument having a body containing a writing point movable relative to the body along a path between a retracted, inoperative position and a projected, writing position, the point being connected to a flexible tubular ink reservoir which, in following the movement of the point along said path performs a nonlinear movement. Specifically, the reservoir may follow a curved path within the body and the body may be of compact form convenient for grasping during writing.

The tubular reservoir may conveniently be held in a swivel-type bearing element so that the movement followed by the reservoir is generally circular.

The body or housing of the instrument may be generally disc shaped or it may be spherical or part spherical. However, it will be recognized that may form conveniently held in one hand is possible.

Where the body is generally disc formed, it preferably has an eccentric portion having an opening through which the writing point is projected and retracted.

As noted hereabove, the tubular reservoir is conveniently mounted in a swivel-type bearing supported within the body for rotation. Most conveniently, this bearing is of disc form having an annular groove within which the reservoir is accommodated and has an operating element projecting to the outside of the body by which the bearing may be moved to project and retract the writing point. The projection cooperates with appropriate means on the body to selectively hold the writing point in its retracted and projected positions. Those means of the body may comprise detents formed in end regions of a slot of the body through which the operating projection extends. Means are provided most preferably within the body to guide the bearing member in its movement.

DESCRIPTION OF THE FIGURES OF THE DRAWINGS

An embodiment of the invention is illustrated, schematically, in the accompanying drawings in which, FIG. 1 is a plan view of a pen according to the present invention;

FIG. 2 is an elevation of the pen of FIG. 1 viewed from the right hand side of that figure;

FIG. 3 is an elevational view of the underside of the pen of FIG. 1;

FIG. 4 shows the pen with its top cover removed; and

FIG. 5 is a view of the top cover.

DESCRIPTION OF THE PREFERRED EMBODIMENT

The writing instrument consists of a generally disc-shaped hollow body or housing 6 having a cover 7 secured to it, conveniently by a screw. The housing or body, is of generally circular outline and has an eccentric projecting portion 8. The side wall of the body has an opening 10 formed therein through which the point of the instrument may be projected and retracted. In the particular embodiment illustrated, the writing point is a ball and has secured to it an ink reservoir 12 in the form of a flexible tube.

For supporting and guiding the reservoir, the body 6 is provided with a swivel bearing 13 which is of disc shape, having a central, bearing-defining, collar 14 mounted upon a corresponding upstanding hollow pivot 15 of the body 6. The pivot 15 conveniently receives the screw which secures the cover 7 to the body.

At the outer periphery of the bearing element 13 a groove 16 is formed by upstanding wall elements 17 (see FIG. 4). The groove 16 is provided with an abutment 18 against which the end of the reservoir 12 most remote from the point of the pen, abuts. The inner surfaces of wall 17 defining the groove 16 most desirably are provided with roughened portions or ribs which engage with the reservoir 12 to increase the frictional interengagement of that reservoir with the bearing 13.

Projecting from the outer wall 17 of the bearing, through a slit 20 formed in the side wall 9 of the body 6, is a manipulating element 19 by which the point of the instrument can be moved between its projected and retracted positions by pivoting movement of the bearing 13, accompanied of course with nonlinear movement of the reservoir 12. Lateral recesses 21 and 22 are formed at the end regions of the slot 20, those recesses defining detents with which element 19 may be engaged to selectively hold the bearing 13 and with it the reservoir and point 11 in positions corresponding to the retracted and projected positions respectively of the point.

The cover 7 is provided on its inner surface with generally radially extending ribs 23 of which the front edges engage upon those edges of upstanding wall 17 most remote from the plane of bearing 13 so as to guide the bearing in its rotary movement.

The radially innermost wall element 17 is relieved and terminates in a linear portion 25 joining outer wall 27 of the bearing element to facilitate movement of the bearing and projection of the point 11. The outermost wall 9 of the housing 6 may be provided with a box-like structure 26 to guide the movement of the writing instrument in the region of the point.

It will be recognized that the pen of the present invention is one which can be slipped easily into a pocket and one which is easily manipulated for writing.

What is claimed is:

1. A writing instrument comprising a body, a writing point secured to a flexible tubular ink reservoir mounted upon a rotatable bearing structure arranged within said body, said point and said ink reservoir being movable relative to said body along a path between a retracted inoperable position and a projected writing position, wherein said ink reservoir performs a nonlinear movement as said point is moved along said path.

2. A writing instrument as claimed in claim 1 wherein said point is a ball.

3. An instrument as claimed in claim 1 wherein said bearing structure is of generally circular shape and is provided with an annular groove within which said reservoir is received.

4. A writing instrument as claimed in claim 3 wherein said annular groove has an abutment face at one end for cooperation with an end of said reservoir most remote from said point.

5. An instrument as claimed in claim 1 wherein said bearing structure comprises a manipulating element projecting from said body and constituting means for moving said bearing structure to cause said point to move along said path.

6. An instrument as claimed in claim 3 wherein said bearing structure comprises a manipulating element projecting from said body and constituting means for moving said bearing structure to cause said point to move along said path.

7. An instrument as claimed in claim 4 wherein said bearing structure comprises a manipulating element projecting from said body and constituting means for moving said bearing structure to cause said point to move along said path.

8. An instrument as claimed in claim 5 wherein said manipulating element projects through a slot in said body end portions of said slot defining detents for cooperation with said manipulating element selectively to secure the manipulating element in a position corresponding to one of said projected and retracted positions of said point.

9. An instrument as claimed in claim 6 wherein said manipulating element projects through a slot in said body end portions of said slot defining detents fcr cooperation with said manipulating element selectively to secure the manipulating element in a position corresponding to one of said projected and retracted positions of said point.

10. An instrument as claimed in claim 2 wherein said manipulating element projects through a slot in said body end portions of said slot defining detents for cooperation with said manipulating element selectively to secure the manipulating element in a position corresponding to one of said projected and retracted positions of said point.

11. An instrument as claimed in claim 8 wherein said detents are defined by marginal edges of lateral recesses disposed at terminal portions of said slot.

12. An instrument as claimed in claim 9 wherein said detents are defined by marginal edges of lateral recesses disposed at terminal portions of said slot.

13. An instrument as claimed in claim 10 wherein said detents are defined by marginal edges of lateral recesses disposed at terminal portions of said slot.

14. A writing instrument as claimed in claim 1 wherein said body comprises two parts in one of which said bearing structure is received, the other of said parts having means cooperating with said bearing structure for guiding that bearing structure in its movement.

15. A writing instrument as claimed in claim 3 wherein said body comprises two parts in one of which said bearing structure is received, the other of said parts having means cooperating with said bearing structure for guiding that bearing structure in its movement.

16. A writing instrument as claimed in claim 4 wherein said body comprises two parts in one of which said bearing structure is received, the other of said parts having means cooperating with said bearing structure for guiding that bearing structure in its movement.

17. A writing instrument as claimed in claim 3 wherein reservoir contacting surfaces of said groove are provided with means improving the frictional interengagement of said reservoir with said groove.

18. A writing instrument as claimed in claim 1 wherein said body is of generally circular outline having an eccentric portion through which said point projects.

* * * * *